US007789667B2

(12) United States Patent
Zhu et al.

(10) Patent No.: US 7,789,667 B2
(45) Date of Patent: Sep. 7, 2010

(54) RF CONNECTOR ASSEMBLY

(75) Inventors: Qing-Man Zhu, Kunshan (CN); Xue-Liang Zhang, Kunshan (CN); Chien-Chiung Wang, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/387,278

(22) Filed: Apr. 30, 2009

(65) Prior Publication Data

US 2009/0275232 A1 Nov. 5, 2009

(30) Foreign Application Priority Data

Apr. 30, 2008 (CN) ..... 2008 2 0035878

(51) Int. Cl.
*H01R 11/30* (2006.01)

(52) U.S. Cl. ..... 439/39; 439/349; 439/578; 439/271

(58) Field of Classification Search ..... 439/38, 439/39, 271, 578, 349, 675
See application file for complete search history.

(56) References Cited

U.S. PATENT DOCUMENTS 5,401,175 A * 3/1995 Guimond et al. ..... 439/38
6,409,519 B1 * 6/2002 Bacon ..... 439/63
6,840,919 B1 * 1/2005 Håkansson ..... 604/175
7,341,458 B1 * 3/2008 Koh ..... 439/39
7,621,753 B1 * 11/2009 Pai ..... 439/63
7,641,476 B2 * 1/2010 Didur et al. ..... 439/39
2006/0051981 A1 * 3/2006 Neidlein et al. ..... 439/39

FOREIGN PATENT DOCUMENTS

TW M257018 2/2005

* cited by examiner

*Primary Examiner*—Neil Abrams
*Assistant Examiner*—Phuong Nguyen
(74) *Attorney, Agent, or Firm*—Ming Chieh Chang; Wei Te Chung; Andrew C. Cheng

(57) ABSTRACT

An RF connector assembly (100) assembly has a first connector and a second connector (3) electrically connecting with the first connector. The first connector includes a first main body (11) defining an interior space (110), an insulative member (12) received in the interior space, a center conductor (13) retained within the insulative member, a flexible bushing (14) and a magnetic member (15) retained in the interior space. The second connector includes a mating member (35) firmly resisting against the flexible bushing under an attractive force exerted by the magnetic member.

11 Claims, 4 Drawing Sheets

RF CONNECTOR ASSEMBLY

BACKGROUND OF THE INVENTION

1. Field of the Invention

The present invention relates to an RF (Radio Frequency) connector assembly, and more particularly to an RF connector assembly having a magnetic member.

2. Description of the Prior Art

Taiwan Patent No. M257018 issued on Feb. 11, 2005 discloses an RF cable connector assembly for transmitting RF signal and comprising an electrical connector and a mating connector. The electrical connector has a first main body defining a hollow, an insulative member received in the hollow, a center conductor retained within the insulative member, and a flexible tubular received in the hollow. The complementary connector screws into the hollow of the first mating member and provides a front mating shoulder for resisting against the flexible tubular. The flexible tubular provides a twisting force for the complementary connector during a backward and forward twisting movement of the complementary connector. It is difficult to provide a controllable twisting force for the complementary connector due to a tolerance of the flexible tubular. Thus, the engagement between the electrical connector and the complementary connector is unreliable.

Hence, an improved RF connector assembly is needed to solve the above problem.

BRIEF SUMMARY OF THE INVENTION

Object of the present invention is to provide an RF connector assembly for providing a reliable engagement between a first connector and a second connector.

The present invention provides an RF (Radio Frequency) connector assembly comprises a first connector and a second connector electrically connecting with the first connector. The first connector includes a first main body defining an interior space, an insulative member received in the interior space, a center conductor retained within the insulative member, a flexible bushing and a magnetic member retained in the interior space. The second connector comprises a mating member firmly resisting against the flexible bushing under an attractive force exerted by the magnetic member for connecting to the first connector.

When the second connector screws into an interior space of the first connector, a mating member of the second connector is firmly sucked by a magnetic member of the first connector for strengthening the engagement between the first connector and the second connector. The flexible bushing of the first connector effectively provides a controllable twisting force for the mating member of the second connector during a backward and forward twisting movement of the second connector.

Other objects, advantages and novel features of the invention will become more apparent from the following detailed description of the present embodiments when taken in conjunction with the accompanying drawings.

DETAILED DESCRIPTION OF THE INVENTION

Figure 1:
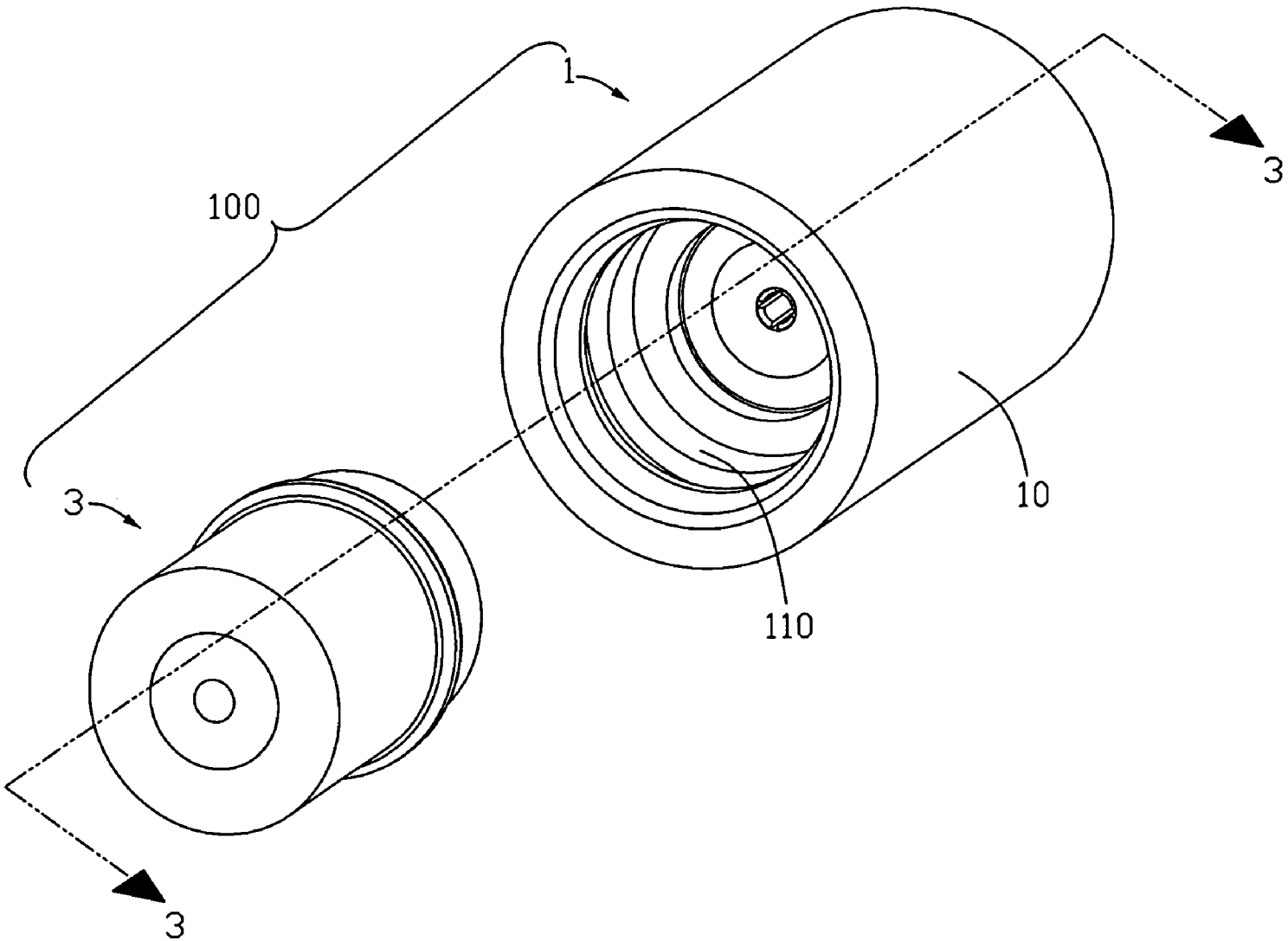
FIG. 1 is a perspective view of a first connector and a second connector of an RF connector assembly.
Figure 2:
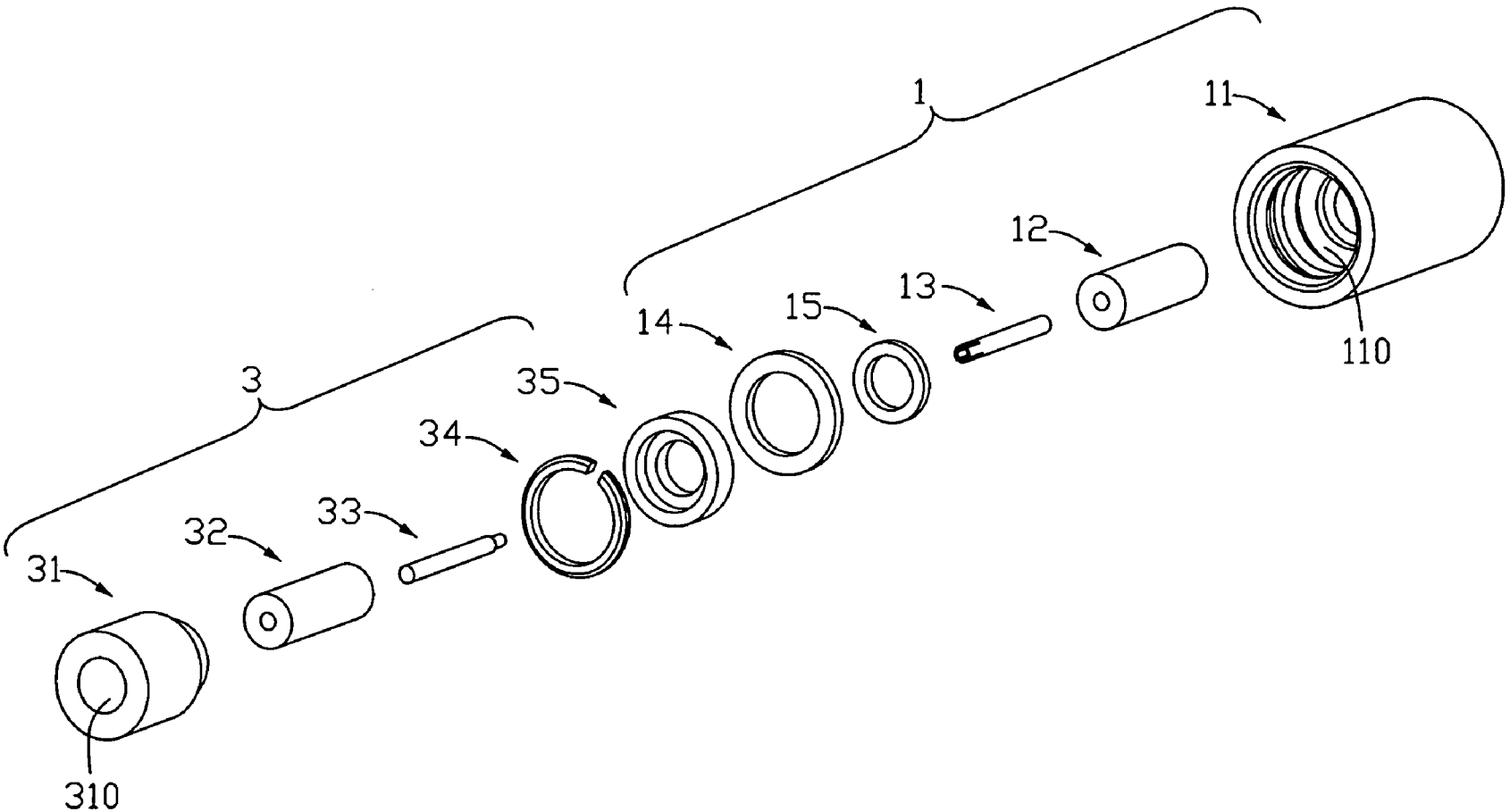
FIG. 2 is an exploded view of the RF connector assembly as shown in FIG. 1.
Figure 3:
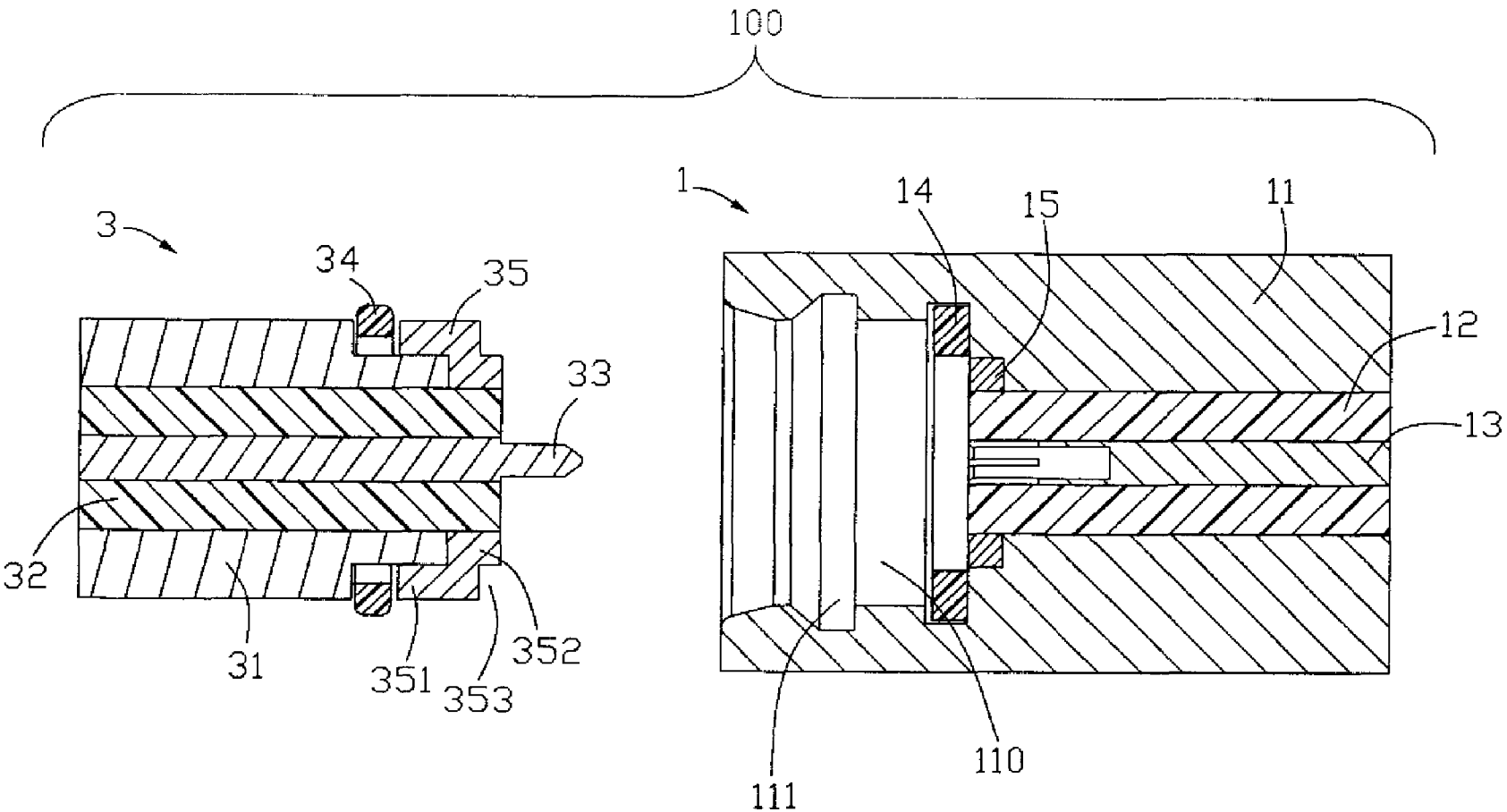
FIG. 3 is a cross-sectional view of the RF connector assembly as shown in FIG. 1 along line 3-3.
Figure 4:
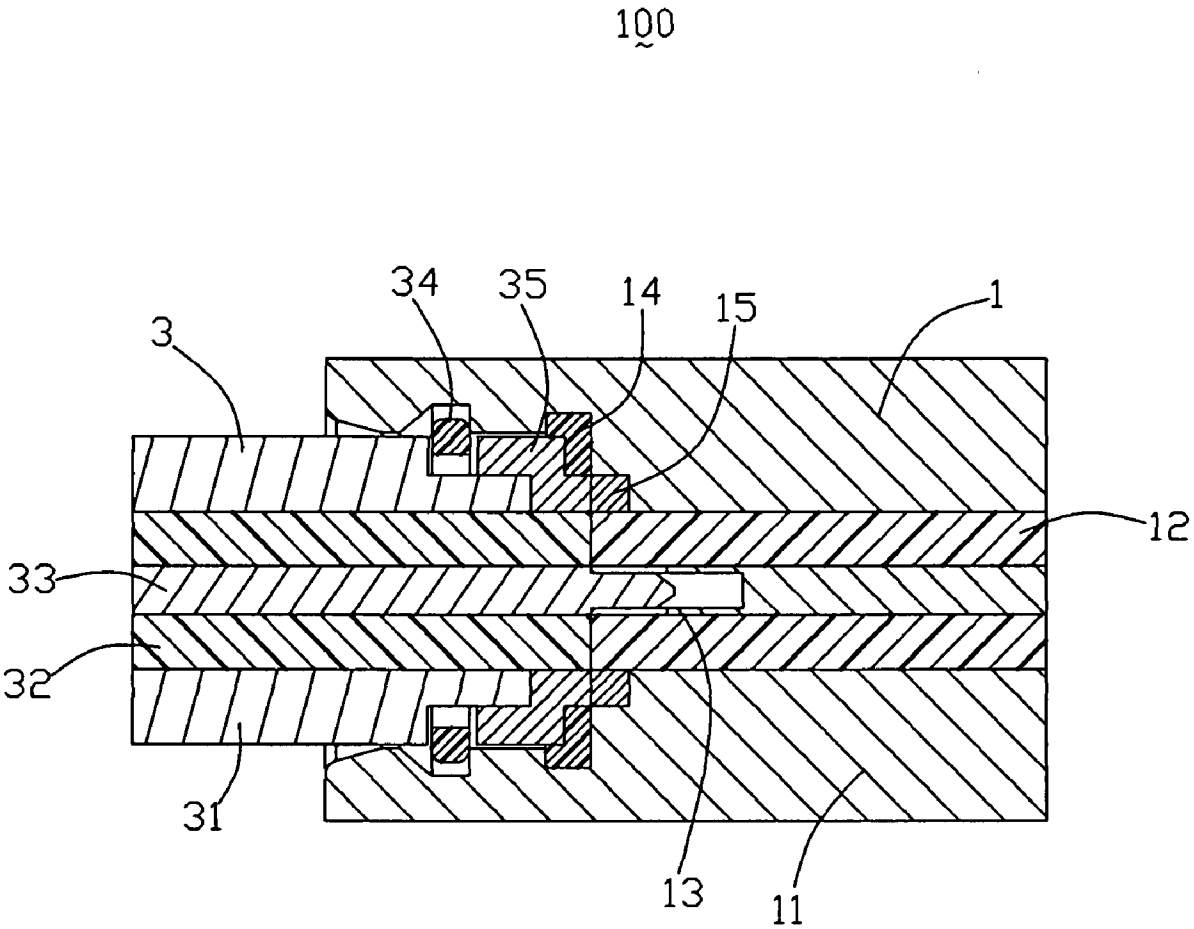
FIG. 4 is a cross-sectional view of the RF connector assembly as shown in FIG. 1, when the second connector is inserted into an interior space of the first connector.

Reference will now be made to the drawing figures to describe the present invention in detail. Referring to FIGS. 1-3, an RF connector assembly 100 comprises a first connector 1 and a second connector 3 for mating with the first connector 1.

Referring to FIGS. 2-3, a first connector 1 has a first main body 11 defining an interior space 110, an insulative member 12 received in the interior space 110, a center conductor 13 retained within the insulative member 12, a flexible bushing 14 and a magnetic member 15 retained in the interior space 110. The first main body 11 comprises an annular recess (not labeled) defined in the inner surface thereof and in communication with the interior space 110, and a receiving room 111 defined therein. The flexible bushing 14 is retained in the annular recess.

The second connector 3 comprises a second main body 31 defining an axial bore 310, an insulator 32 received in the axial bore 310, a central terminal 33 extending through the insulator 32 for electrically connecting with the center conductor 13 of the first connector 1 and a mating member 35 retained in the axial bore 310. The second connector 3 has a tubular 34 retained in the receiving room 11. The mating member 35 of the second connector 3 has a first shoulder 351 for resisting against the flexible bushing 14, a second shoulder 352 sucked to the magnetic member 15 of the first connector 1 and resisting against the flexible bushing 14, and an indentation 353 formed between the first shoulder 351 and the second shoulder 352 for receiving the flexible bushing 14.

When the second connector 3 screws into the interior space 110 of the first connector 1, the second shoulder 352 of the mating member 35 is sucked by the magnetic member 15 of the first connector 1. The flexible bushing 14 is located between a front mating face of the first connector 1 and the first shoulder 351 of the mating member 35 of the second connector 3 and provides a symmetrically twisting force for the second connector 3 during a backward and forward twisting movement of the second connector 3.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An RF (Radio Frequency) connector assembly, comprising:

a first connector comprising a first main body defining an interior space, an insulative member received in the interior space, a center conductor retained within the insulative member, a flexible bushing and a magnetic member retained in the interior space; and a second connector electrically connecting with the first connector and comprising a mating member firmly resisting against the flexible bushing under an attractive force exerted by the magnetic member;

said first connector comprises an annular recess defined in the inner surface of the first main body and in communication with the interior space, and wherein said flexible bushing is retained in the annular recess;

said flexible bushing is sandwiched between the magnetic member of the first connector and the mating member;

said mating member has a first shoulder and a second shoulder for resisting against the flexible bushing, the second shoulder sucked by the magnetic member and an indentation formed between the first shoulder and the second shoulder for receiving the flexible bushing.

2. The RF connector assembly as claimed in claim 1, wherein said second connector comprises a second main body defining an axial bore, an insulator received in the axial bore and a central terminal extending through the insulator for electrically connecting with the center conductor of the first connector.

3. The RF connector assembly as claimed in claim 2, wherein said first connector comprises a receiving room defining in a first main body and in communicating with the interior space, the second connector has a tubular surrounding the second main body and retained in the receiving room.

4. The RF connector assembly as claimed in claim 1, wherein the second connector screws into the interior space of the first connector.

5. The RF connector assembly as claimed in claim 4, wherein the second shoulder of the mating member is sucked by the magnetic member of the first connector.

6. The RF connector assembly as claimed in claim 5, wherein the flexible bushing is located between a front mating face of the first connector and the first shoulder of the mating member of the second connector and provides a symmetrically twisting force for the second connector during a backward and forward twisting movement of the second connector.

7. The RF connector assembly as claimed in claim 6, wherein said first shoulder and the second shoulder have different diameters.

8. An RF (Radio Frequency) connector assembly, comprising:

a first connector comprising a first main body defining an interior space, an insulative member received in the interior space, a center conductor retained within the insulative member, a magnetic member retained in the interior space; and a second connector electrically connecting with the first connector and comprising a mating member firmly intimately attracted by the magnetic member in an axial direction under condition that said magnetic member and said mating member are engaged with each other in said axial direction; wherein a deformable bushing is located between an interface of said first connector and said second connector, and deformed by said mating member at least either axially or radially, said mating member has a first shoulder and a second shoulder for resisting against the flexible bushing, the second shoulder sucked by the magnetic member and an indentation formed between the first shoulder and the second shoulder for receiving the flexible bushing.

9. The RF connector assembly as claimed in claim 8, wherein said deformable bushing is located radially farther from the center conductor than said magnetic member.

10. The RF connector assembly as claimed in claim 8, wherein said deformable member is associated with the first connector rather than the second connector.

11. The RF connector assembly as claimed in claim 8, wherein said mating member defines a Z-like configuration in an axial cross-sectional view.

* * * * *